US005132653A

United States Patent [19]

Nakatake et al.

[11] Patent Number: 5,132,653

[45] Date of Patent: Jul. 21, 1992

[54] ELECTROMAGNETIC SWITCH

[76] Inventors: Yoshiteru Nakatake; Tsutom Kurita; Yoshimi Inohara, all of c/o Honda Lock Manufacturing Co., Ltd. of No. 3700, Aza-Wadayama, Oaza-Shimonaka, Sadowaracho, Miyazaki-gun, Miyazaki-ken; Mitsuru Uehara, c/o Honda R & D Co., Ltd., No. 4-1, Chuo 1-chome, Wako-shi Saitama-ken, all of Japan

[21] Appl. No.: 449,146

[22] Filed: Dec. 14, 1989

Related U.S. Application Data

[62] Division of Ser. No. 241,741, Sep. 8, 1988, abandoned.

[30] Foreign Application Priority Data

| | | | |
|---|---|---|---|
| Sep. 9, 1987 | [JP] | Japan | 62-138029 |
| Sep. 9, 1987 | [JP] | Japan | 62-138030[U] |
| Sep. 9, 1987 | [JP] | Japan | 62-138031 |
| Sep. 9, 1987 | [JP] | Japan | 62-138032[U] |
| Sep. 9, 1987 | [JP] | Japan | 61-149083[U] |
| Sep. 29, 1987 | [JP] | Japan | 62-149082[U] |

[51] Int. Cl.[5] ..... H01H 9/02

[52] U.S. Cl. ..... 335/202; 335/78; 200/293

[58] Field of Search ..... 335/78-86, 335/121, 124, 129, 200, 141, 142, 143; 200/293-305

[56] References Cited

U.S. PATENT DOCUMENTS

| | | | |
|---|---|---|---|
| 4,725,801 | 2/1988 | Snyder | 335/126 |
| 4,887,056 | 12/1989 | Kajino et al. | 335/131 |

FOREIGN PATENT DOCUMENTS

| | | |
|---|---|---|
| 61-16840 | 1/1986 | Japan . |
| 61-18556 | 2/1986 | Japan . |
| 61-91820 | 5/1986 | Japan . |

*Primary Examiner*—Leo P. Picard
*Assistant Examiner*—Lincoln Donovan
*Attorney, Agent, or Firm*—Armstrong, Nikaido, Marmelstein, Kubovcik & Murray

[57] ABSTRACT

The present invention is directed to an electromagnetic switch that includes a casing in which are received a yoke, a bobbin, a coil, a plunger, and contacts. The plunger is formed of an electrically conductive material and the casing is formed of an insulating material. The casing comprises a square box-shaped body and a covering member fitted in an open end of the body. The yoke includes a sheet member having a generally U-shaped section and having opposite end portions between which a portion of the covering member is interposed. The opposite end portions are formed in part into at least one pair of inwardly extending lugs force-fitted in the above portion of the covering member. The covering member has a recess formed in a side surface thereof opposed to the contacts. The covering member has a partition wall formed thereon and separating the contacts from leader ends of the coil.

12 Claims, 13 Drawing Sheets

ELECTROMAGNETIC SWITCH

This application is a division of application Ser. No. 241,741 filed Sep. 8, 1988 now abandoned.

BACKGROUND OF THE INVENTION

This invention relates to electromagnetic switches which are used to close and open starting motor circuits for engines in automotive vehicles, and like circuits.

An electromagnetic switch of this kind has been proposed by Japanese Provisional Utility Model Publication (Kokai) No. 61-18556 (hereinafter referred to as "Publication A"), which comprises a casing formed of an electrically conductive magnetic material and adapted to be fixed to a mounting structure such as a vehicle body, a bobbin wound with a coil, a plunger fitted in the bobbin for movement therein in response to energization of the coil to move a movable contact member into or out of contact with a pair of fixed contact members, yokes arranged at opposite axial ends of the bobbin and in contact with the casing and an insulating plate member secured to an axial end of the plunger opposed to the movable contact member. The fixed contact members are rigidly fitted through a covering member, and each have a flat contact portion at its base end disposed for contact with the movable contact member, and a rod-shaped portion extending through the covering member and having an opposite outer end externally threaded for connection with a connecting member of an external circuit by means of a nut fitted on the threaded outer end.

According to the electromagnetic switch of Publication A, the aforementioned insulating member is interposed between the plunger and the movable contact member for the following reason: the movable and fixed contact members, which are usually formed of copper, are worn due to their repeated contacting actions to produce a considerable amount of fine chips or particles (particles of copper). These chips or particle are scattered and accumulated on peripheral parts, which causes leakage current to flow from the contact members to the mounting structure (vehicle body) through the plunger, yokes, and casing, particularly when the contacts are closed by the plunger receded into the bobbin due to energization of the coil. The insulating member serves to prevent the flow of leakage current.

However, the use of the insulating member does not only result in an increased number of component parts as well as in an increased number of man-hour for assemblage, but also involves the problem that the it is necessary to provide a supplement structure to obtain sufficient heat radiation of the hot contacts, especially the movable contact member, if an insulating member as aforementioned is employed.

Further, according to Publication A, if the electromagnetic switch is used to turn on and off an engine starting motor which consumes a large amount of current, the amount of fine chips or particles of copper produced is particularly large. The chips or particles are scattered and adhere to the movable contact member and the fixed contact members to degrade the insulation therebetween. To prevent this, a recess is formed in an upper end face of the plunger for collecting the chips or particles. However, since the chips or particles are not only scattered to the contact members, but also even to leader ends of the coil which are exposed to the outside of the coil, so that after a long term use the chips or particles may form an additional contact between the opposite leader ends of the coil.

Further, according to Publication A, the electromagnetic switch is not always used in a fashion being uprightly mounted on a mounting structure, but may be mounted in an inverted fashion, depending upon the conditions of the mounting space. However, when the electromagnetic switch is thus invertedly mounted, the above-mentioned additional contact will be formed, since the conventional switch has no suitable place on which the chips or particles are accumulated.

Another disadvantage with Publication A is that the fixed contact members have a special configuration having the flat contact portion and the rod-shaped portion. To obtain the special configuration, for example, a copper bar is wrought such that one end of the bar is squashed and stamped into a flat shape, and the other end threaded to form an external thread thereon, which takes much labor and time, resulting in a high manufacturing cost.

Another electromagnetic switch of this kind has been proposed by Japanese Provisional Utility Model Publication (Kokai) No. 61-16840 (hereinafter referred to as "Publication B"), which comprises a cylindrical bobbin, a coil wound around the bobbin, a plunger fitted in the bobbin for movement therein in response to energization of the coil, a movable contact member arranged for movement in response to the movement of the plunger, fixed contact members arranged for contact with the movable contact members, and a cylindrical casing accommodating the above-mentioned components and also serving as a magnetic path-forming yoke.

The electromagnetic switch according to Publication B essentially requires means for preventing rotation of the cylindrical bobbin relative to the cylindrical casing. Further, the electromagnetic switch is s constructed that when the coil is energized, the plunger moves downwardly into contact with the bottom surface of the casing whereby the movable contact member correspondingly moves into contact with the fixed contact members. Therefore, it also essentially requires means for preventing leakage current from flowing from the contacts to the casing through the plunger. Specifically, an insulating member as the leakage current-preventing means is interposed between the plunger and the movable contact member, or between the plunger and the casing.

Moreover, the electromagnetic switch according to Publication B structurally has limited resistance to vibrations. Therefore, in the case of mounting the switch in the body of an automotive vehicle, the switch has to be mounted at a location other than one where large vibrations may occur, thus being limited in mounting location.

Another electromagnetic switch of this kind has been proposed by Japanese Provisional Patent Publication (Kokai) No. 61-91820 (hereinafter referred to as "Publication C"), which carries a fuse unit formed of a fuse casing and a blade fuse accommodated therein, the fuse casing being secured on top of a main casing of the switch by means of engagement of engaging protuberances formed on opposite lateral side edges of a covering member covering the main casing, with respective engaging holes formed in opposite lateral side edges of the fuse casing. Further, the fuse casing in turn carries thereon a coupler for connecting the electromagnetic switch to connecting wires leading to load circuits. The coupler has a cover fitted over the fuse casing and engaged therewith by means of engagement of downwardly depending engaging pieces provided at opposite lateral side surfaces of the cover, with respective protuberances formed on opposite lateral side surfaces of the fuse casing.

The main casing has a pair of fixed contact members, one of which is to be connected to a power supply such as a car battery, and the other to a starting motor circuit, and a movable contact member being movable in response to movement of a plunger energized by a coil into and out of contact with the fixed contact members. The fuse casing has a coupling terminal formed integrally therewith and which couples the one fixed contact member connected to the power supply, to one end of the blade fuse, the other end of which is connected to load circuits which apply electrical loads on the automotive vehicle. The fuse casing also has another coupling terminal formed integrally therewith. The first-mentioned and another coupling terminals of the fuse casing are joined, respectively, to the one and the other fixed contact members of the main casing, by means of nuts threadedly fitted on externally threaded outer ends of the fixed contact members, to thus unite the fuse unit with the main casing of the electromagnetic switch.

According to Publication C, the coupling between the fuse casing and the cover of the coupler, and the coupling between the fuse casing and the covering member of the main casing are made by means of mere engagement of protuberances with engaging pieces, and that of protuberances with engaging pieces, respectively. Therefore, the assembly of the fuse unit and the electromagnetic switch is not perfectly resistant or proof against water. Moreover, since the two coupling terminals laterally project from the fuse casing, it is difficult to provide waterproof means for the assembly.

Further, according to Publication C, since the fuse casing of the fuse unit is formed integrally with the two coupling terminals, this integral formation requires a great number of man-hour to fabricate. Besides, the provision of the another coupling terminal on the fuse casing invites an increase in the manufacturing cost.

SUMMARY OF THE INVENTION

A first object of the invention is to reduce the number of component parts of the electromagnetic switch as well as the number of man-hours required for assembling same, and also to enhance the heat radiation of the contacts.

A second object of the invention is to prevent consumption of leakage current flowing from the contacts to the mounting structure and avoid formation of additional contact when the contacts are in an open state, due to production of chips or particles of the contacts-forming material caused by repeated closing and opening actions of the contacts.

A third object of the invention is to simplify the structure of the contacts and its peripheral parts and facilitate and connection with external circuits.

A fourth object of the invention is to prevent dislocation of the bobbin relative to the casing of the electromagnetic switch, and enhance the resistance to vibrations.

A fifth object of the invention is to facilitate the coupling of the electromagnetic switch with a fuse unit, and also facilitate application of perfect waterproofing to the coupling.

A sixth object of the invention is to enhance the water resistance of the fuse unit per se.

According to the invention, there is provided an electromagnetic switch including:

a yoke formed of a magnetic material;

a bobbin received in the yoke;

a coil wound around the bobbin;

a plunger accommodated within the bobbin, the plunger being movable axially of the bobbin in response to energization of the coil;

a movable contact member being movable with movement of the plunger;

at least one fixed contact member with which the movable contact member is brought into and out of contact; and a casing in which are received the yoke, bobbin, coil, plunger, movable contact member and fixed contact member.

In a first aspect of the invention, the electromagnetic switch is characterized in that the plunger is formed of an electrically conductive material and the casing is formed of an insulating material.

In a second aspect of the invention, the casing comprises a square box-shaped body having a closed end and another open end, and a covering member fitted in the another open end of the body; and the yoke comprises a sheet member having a generally U-shaped section and having opposite end portions between which a portion of the covering member is interposed, the opposite end portions being formed in part into at least one pair of inwardly extending lugs, the lugs being force-fitted in the portion of the covering member.

In a third aspect of the invention, the casing comprises a body, and a covering member covering the body, the covering member having a recess formed a side surface thereof opposed to the contact means: and the covering member has a partition wall formed thereon and separating the contact means from the leader ends of the coil.

In a fourth aspect of the invention, the fixed contact member is formed of a sheet member bent in a U-shape, the sheet member having a pair of horizontal portions extending parallel with and being spaced from each other, and a vertical portion bridged between the horizontal portions, one of the horizontal portions being located at one side of the covering member remote from the plunger, the other of the horizontal portions being located at another side of the covering member close to the plunger, the one of the horizontal portions having a through hole formed therein, the one of the horizontal portions being connectible to a connecting terminal of an external circuit by a bolt fitted through the through hole and a nut threadedly fitted on the bolt, the other of the horizontal portions being disposed to be in and out of contact with the movable contact member.

In a fifth aspect of the invention, the electromagnetic switch also has a fuse unit including a housing joined to the casing, a fuse mounted in the housing and connected between the one fixed contact member and at least one load circuit, and a coupling terminal connected between the one fixed contact member and the fuse, wherein:

at least one pair of engaging protuberances is formed on one of the housing of the fuse unit and the casing and projecting laterally therefrom, at least one pair of recesses being formed on the other of the housing of the fuse unit and the casing, the engaging protuberances elastically engaging in the recesses; and the coupling terminal has a portion thereof interposed between the fuse unit and the casing, the one fixed contact member and the coupling terminal being fastened to the connecting terminal of the power supply by a bolt.

In a sixth aspect of the invention, the fuse unit is composed of a fuse holding frame accommodating the fuse and fitted to the casing, a removable cap covering the fuse holding frame, a sealing member interposed between the fuse holding frame and the cap, and a water-proofing agent filled in a space defined between the fuse unit and the casing.

The above and other objects, features, and advantages of the invention will be apparent from the ensuring detailed description taken in conjunction with the accompanying drawings.

DETAILED DESCRIPTION

The invention will be described in detail with reference to the drawings showing embodiments thereof.

FIGS. 1 through 11 show a first embodiment of the invention.

Figure 1:
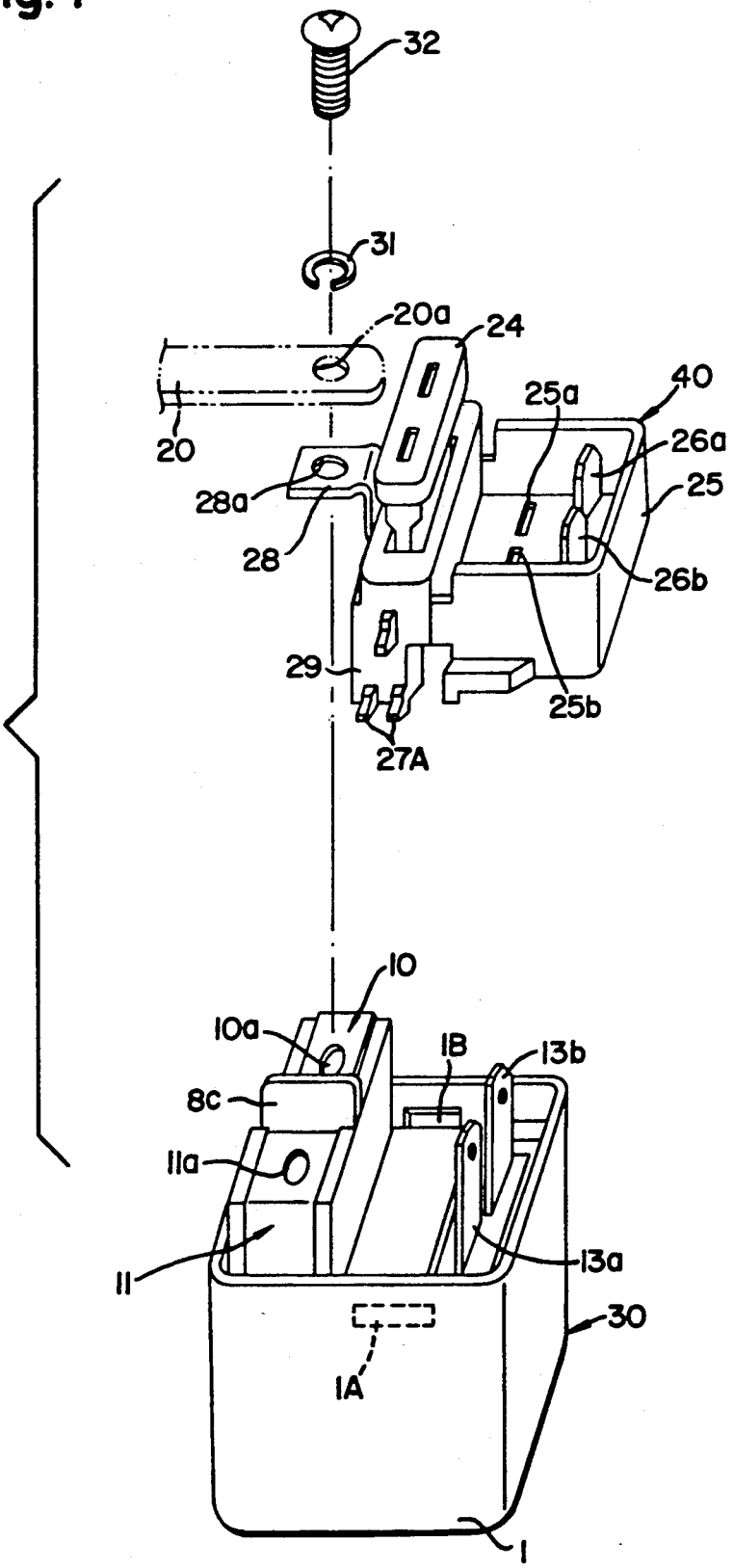
FIG. 1 is an exploded perspective view of an electromagnetic switch according a first embodiment of the invention.
Figure 2:
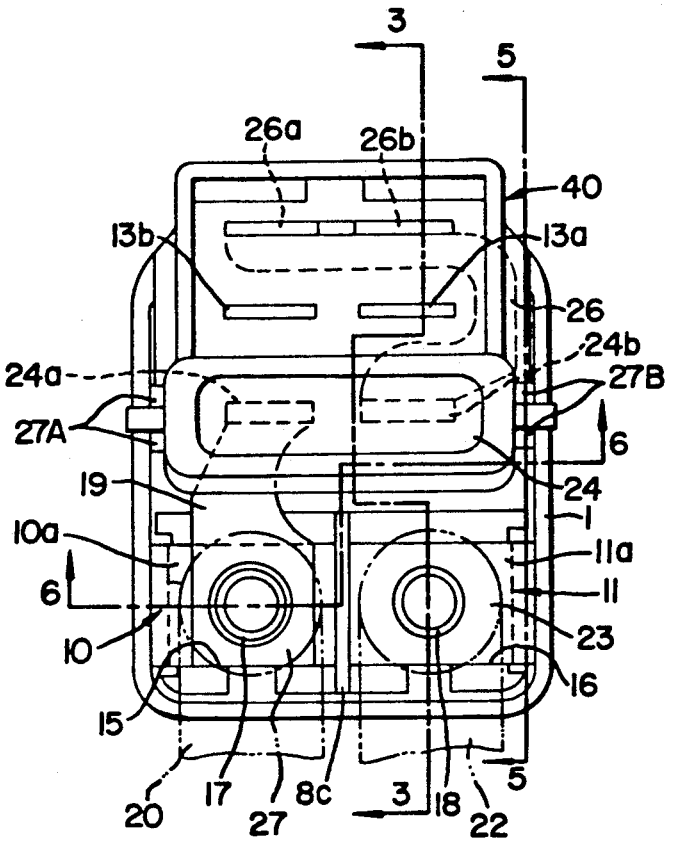
FIG. 2 is a top plan view of the electromagnetic switch of FIG. 1, which is an assembled state.
Figure 3:
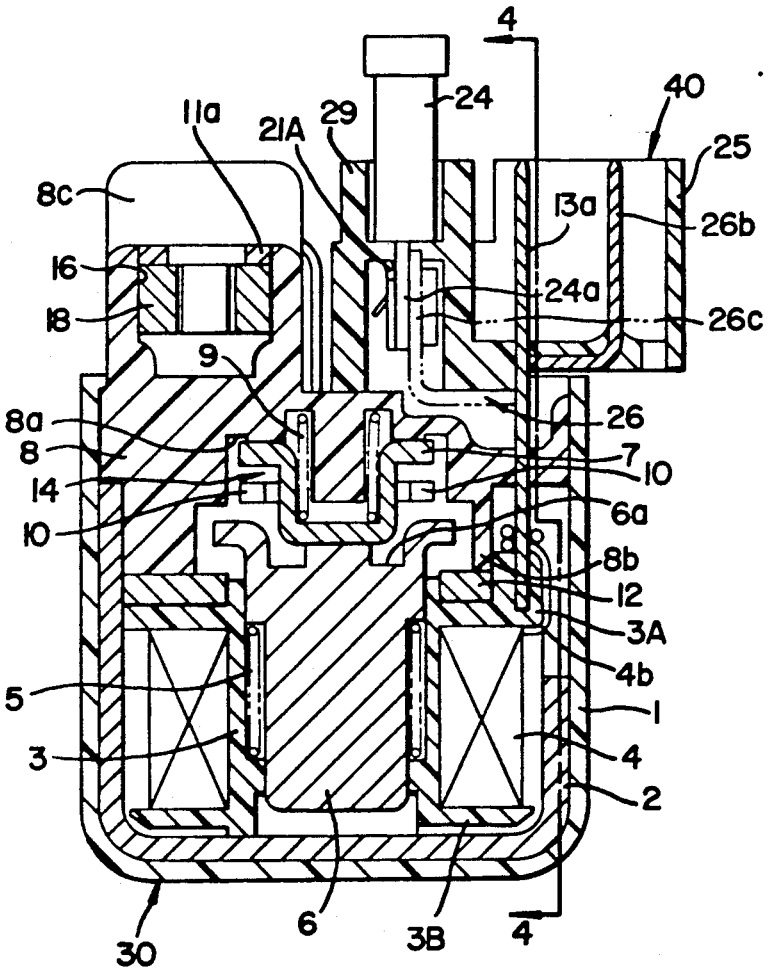
FIG. 3 is a longitudinal sectional view taken along line III—III in FIG. 2.

Referring first to FIGS. 1 through 3, an electromagnetic switch 30 according to the first embodiment has a square casing 1 with an open upper side. Fitted in the casing 1 along a bottom and opposite sides thereof is a yoke 2 having a generally U-shaped section and accommodating a bobbin 3 with a pair of rectangular flanges 3A and 3B at its opposite ends. The bobbin 3 has an central hollow shaft portion wound with a coil 4. A plunger 6 is slidably fitted in the central hollow shaft portion and biased in one axial direction by a return spring 5.

A generally U-shaped movable contact member 7 is arranged opposite an upper end of the plunger 6 as viewed in FIG. 3, and kept in urging contact therewith by a spring 9 seated on a covering member 8 of the casing 1. The movable contact member 7 is disposed for contact with a pair of fixed contact members 10 and 11 mounted on the casing through the covering member 8, one of which is to be connected to a power supply, and the other to a first load circuit. Another plate-shaped yoke 12 is interposed between the upper flange 3A and the covering member 8, through which the plunger 6 movably extends.

The upper end of the plunger 6 has an end face formed with an annular recess **6*a*, while the covering member 8 has a lower side surface formed with an annular recess 8*a* extending along the periphery of the movable contact member 7. Further, the covering member 8 has a downwardly pending partition wall 8*b* formed integrally therewith and separating the contacts 14 formed by the movable and fixed contact members 7, 10 and 11 from leader ends 4*a* and 4*b* of the coil 4. The partition wall 8*b* extends downwardly to the yoke 2 interposed between the rest of the covering member 8 and the upper flange 3A of the bobbin 3**.

Figure 4:
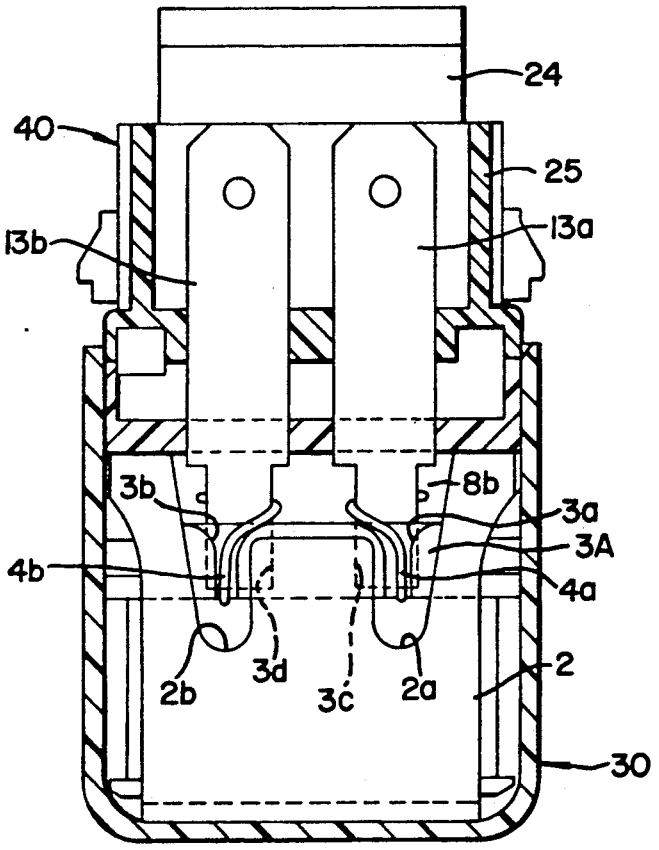
FIG. 4 is a longitudinal sectional view taken along line IV—IV in FIG. 3.

The leader ends **4*a*, 4*b* of the coil 4 extent to the outside, respectively, through notches 3*a* and 3*b* formed in an outer peripheral edge of the upper flange 3A, as shown in FIG. 4. The upper flange 3A is further formed with fitting holes 3*c* and 3*d* at locations corresponding, respectively, to the notches 3*a*, 3*b*. Force fitted, respectively, in these fitting holes 3*c*, 3*d* are base ends of connecting terminals 13*a* and 13*b* to which are soldered the leader ends 4*a*, 4*b* of the coil 4. The yoke 2 is formed with clearance recesses 2*a* and 2*b* at locations corresponding, respectively, to the notches 3*a*, 3*b*, for preventing the leader ends 4*a*, 4*b* of the coil 4 from coming into contact with the yoke 2**.

Figure 11:
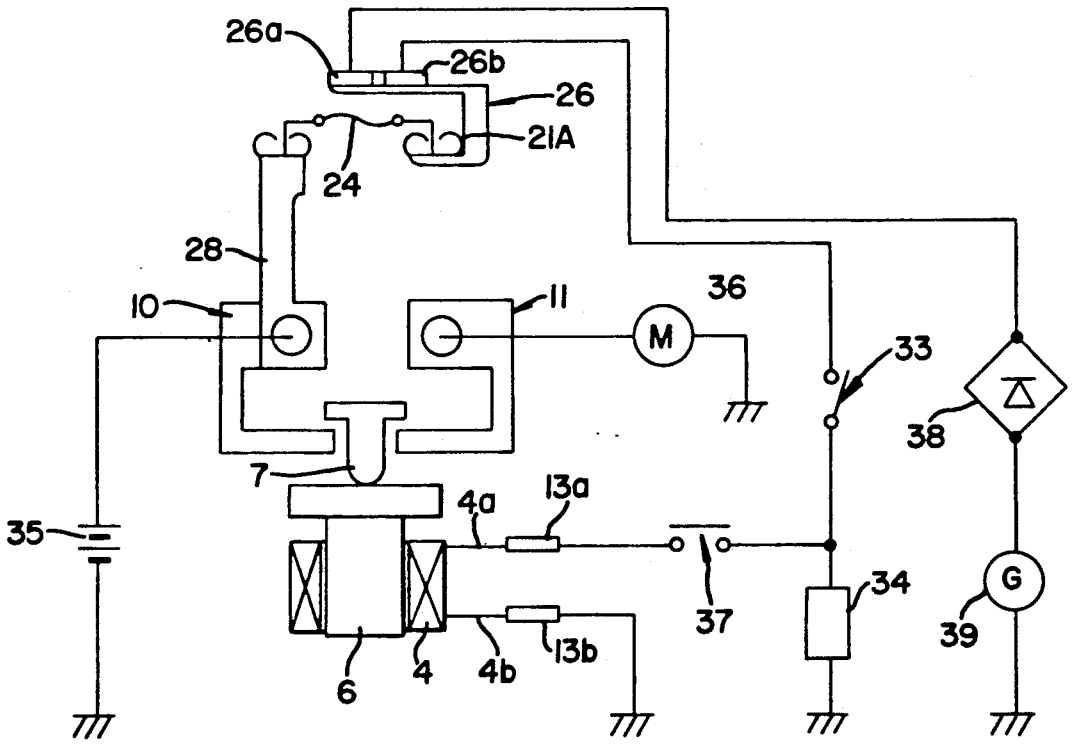
FIG. 11 is a circuit diagram showing an example of an electrical circuit including the electromagnetic switch of FIG. 1 as a component part.

The connecting terminals **13*a*, 13*b* upwardly extend through the covering member 8 to be connected to a switch 37 , hereinafter referred to, and grounded, respectively (FIG. 11**).

Figure 6:
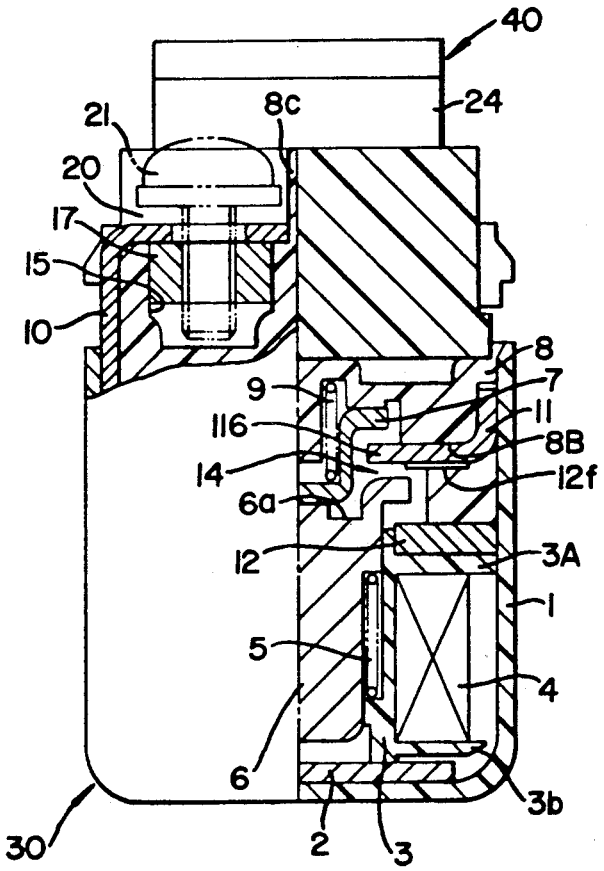
FIG. 6 is a longitudinal sectional view taken along line VI—VI in FIG. 2.

As shown in FIGS. 2 and 6, the covering member 8 has an upper side surface formed with terminal-accommodating recesses 15 and 16 with a partition **8*c* intervening therebetween, and in which are loosely fitted square nuts 17 and 18, respectively, on which are superimposed ends of the fixed contact members 10 and 11**, respectively.

Figure 9:
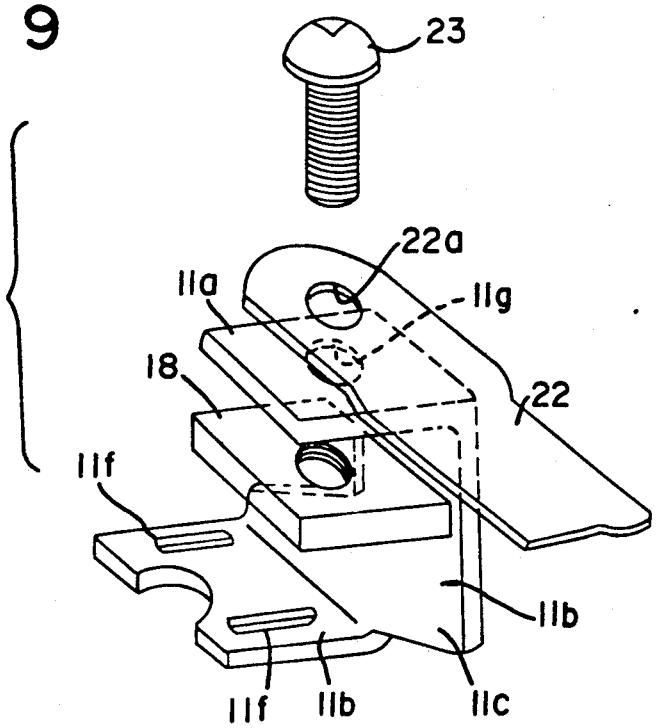
FIG. 9 is an exploded perspective view of a fixed contact member for connection to a starting motor circuit.
Figure 10:
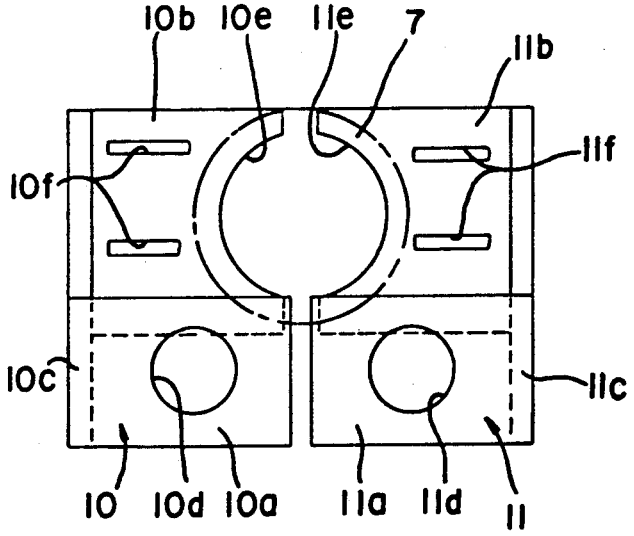
FIG. 10 is a top plan view of the fixed contact members of FIGS. 8 and 9.

As shown in detail in FIG. 10, both the fixed contact members 10 and 11 each comprise a sheet member which has a generally U-shaped section. The fixed contact members 10 and 11 each have upper and lower horizontal portions **10*a* and 10*b*; 11*a* and 11*b* extending parallel with each other in a spaced and slightly offset manner, and a vertical portion 10*c*; 11*c* bridged between the horizontal portions 10*a* and 10*b*; 11*a* 11*b*. The upper horizontal portions 10*a* and 11*a* have respective through bores 10*d* and 11*d* formed therethrough for inserting bolts therethrough. The lower horizontal portions 10*b* and 11*b* have respective semicircular cut-outs 10*e* and 11*e* formed therein for being brought into and out of contact with the peripheral edge of the movable contact member 7. As shown in FIG. 6, the lower horizontal portions 10*b* and 11*b* are fitted through holes 8B, only one of which is shown, formed in the covering member 8 at its opposite sides. The lower horizontal portions 10***b* and 11*b* have, as shown in FIGS. 8 and 9, respective lower end faces thereof formed with a suitable number of e.g. two in the first embodiment, engaging ribs 10*f* and 11*f* downwardly projecting, which are formed by pressing and the like.

Figure 8:
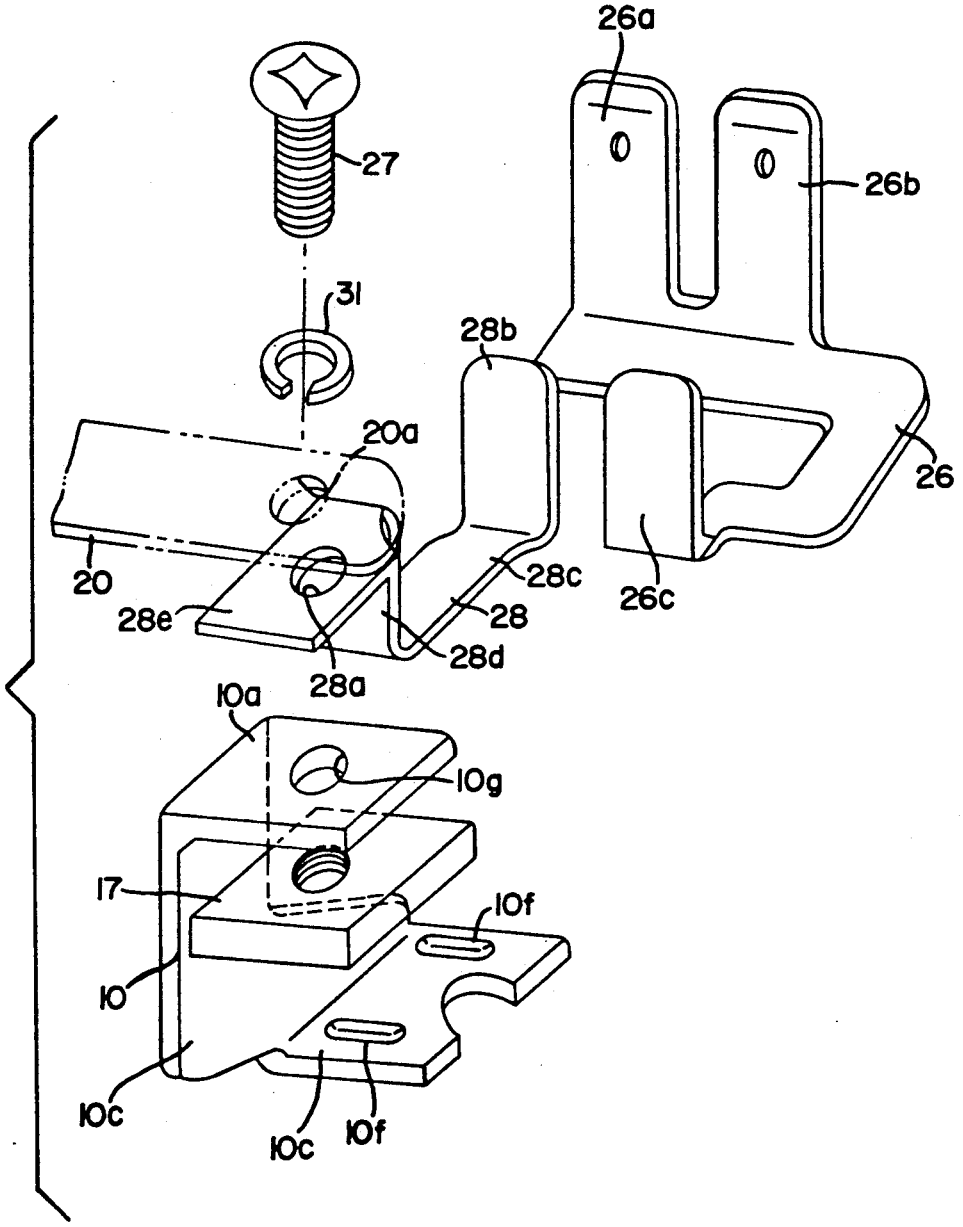
FIG. 8 is an exploded perspective view of a fixed contact member and its peripheral parts for connection to a power supply.

As will be understood from FIG. 8, the upper horizontal portion 10*a* of the fixed contact member 10 is clamped to an power supply-connecting terminal 20 and a coupling terminal 28 by a bolt 27, a washer 31, and a nut 17. The upper horizontal portion 11*a* of the fixed contact member 11 is clamped to a load-connecting terminal 22 connected to the starting motor by a bolt 23 and a nut 18.

On the other hand, a fuse unit 40 is provided on an upper portion of the casing 1, which has a housing formed of a fuse mounting section 24 on which a blade fuse 24 is mounted, and a terminal holding frame 25 disposed adjacent the fuse mounting section 24. The terminal holding frame 25 has a bottom wall thereof formed with through holes 30*a* and 30*b* through which extend the connecting terminals 13*a* and 13*b*, and also formed with through holes, not shown, through which extend bifurcated tips 26*a* and 26*b* of an output terminal 26 which is connected via the blade fuse 21 to a second load circuit.

The output terminal 26 and the coupling terminal 28 are first mounted into the housing of the fuse unit 40 through the bottom wall thereof, and then the power supply-connecting terminal 20, the fixed contact member 10, and the coupling terminal 28 are clamped together by the nut 27, etc. as mentioned before.

Thus, the output terminal 26 and the coupling terminal 28 are interposed between the electromagnetic switch 30 and the fuse unit 40. The terminals 26 and 28 are each formed in a separate body from the housing of the fuse unit 40, and formed of a bent electrically conductive sheet.

As shown in FIG. 8, the coupling terminal 28 and the output terminal 26 have respective horizontal intermediate portions 28*c*, 26*d* extending along the lower end wall of the housing of the fuse unit 40, and respective vertical connecting portions 28*b* and 26*c* extend continuously from ends of the horizontal portions. The respective connecting portions 28*b* and 26*c* are force fitted from the bottom side of the fuse unit 40 into holes, not shown, formed through a central partition wall of the fuse mounting section 29 of the fuse unit 40, as indicated by the two-dot chain lines in FIG. 3 showing the connecting portion 26*c* alone. The output terminal 26 has the other end with the bifurcated connected portions 26*a* and 26*b* extending vertically and continuously therefrom, which are also force fitted into the through holes form the bottom side of the fuse unit 40. The connecting portions 28*b* and 26*c* are thus connected to blades 24*a* and 24*b* of the blade fuse 24, together with connectors 21A, only one of which is shown in FIG. 3. The coupling terminal 28 further has a vertical portion 28*d* extending from the other end of the intermediate horizontal portion 28*c* along a side wall of the fuse mounting section 29, and a connecting end portion 28*e* extending from the vertical portion 28*d* and connected to the fixed contact member 10 and the power supply-connecting terminal 20.

The lower end portion of the fuse unit 40 and the upper end portion of the cover member 8 form joining portions having corresponding shapes, so that the former is snugly fitted in the latter.

When the fuse unit 40 is mounted onto an electromagnetic switch 30, a pair of engaging protuberances 27A and a pair of engaging protuberances 27B (in FIG. 2) formed on opposite sides of the fuse mounting section 29 are elastically engaged in recesses 1A and 1B (in FIG. 1) formed in opposite inner walls of the square casing 1, as described later.

After thus mounting the fuse unit 40 onto the electromagnetic switch 30, an adhesive is filled as a waterproof agent into a space defined between the upper portion of the casing 1 and the fuse unit 40.

Figure 5:
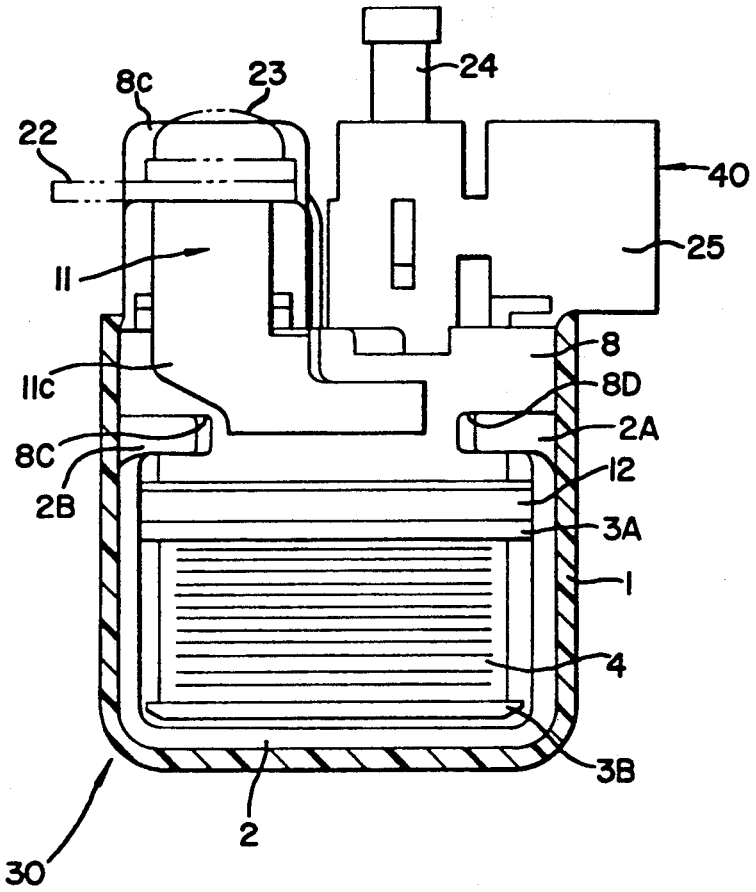
FIG. 5 is a longitudinal sectional view taken along line V—V in FIG. 2.

As shown in detail in FIG. 5, two pairs of lugs 2A and 2B, only one pair of which are shown, are formed on the U-shaped yoke 2 at opposite upper ends thereof, and are inserted into two pairs of grooves 8C and 8D, only one pair of which are shown, formed in opposite side surfaces of the covering member 8. The lugs are caulked to firmly join the yoke 2 to the covering member 8.

The manner of assembly of the electromagnetic switch according to the invention having the above-described construction is as follows. First, the connecting terminals 13*a*, 13*b* are force fitted into the upper flange 3A of the bobbin 3 wound with the coil 4. The yoke 12 is then mounted onto the upper flange 3A of the bobbin 3. The plunger 6 is then fitted into the bobbin 3, together with the return spring 5. Thus the yoke 2 accommodates the bobbin, the plunger and the return spring 5 put together as above.

In the meanwhile, the movable contact member 7 is mounted onto the lower side of the covering member 8, with the spring 9 interposed therebetween. Two nuts 17, 18 are mounted into the upper side of the covering member 8, and then the fixed contact members 10, 11 are engaged into the terminal-accommodating recesses 15, 16 such that the horizontal portions 10*a*, 11*a* are positioned on the nuts 17, 18 and the fixed contact members 10, 11 are opposed to each other.

The thus assembled covering member 8, contact members, etc. are mounted onto the assembled yoke 2, plunger 6 etc. and the lugs 2A, 2B protruding from the opposite inner side walls of the yoke 2 are caulked to firmly join the yoke 2 and the covering member 8 together. On this occasion, the leader ends 4*a*, 4*b* of the coil 4 are pulled outward along the notches 3*a*, 3*b* of the flange 3A, and soldered to the base ends of the connecting terminals 13*a*, 13*b*.

Then, the output terminal 26 with the connector 21A is mounted onto the lower side of the fuse unit 40, followed by mounting the blade fuse 24 onto the fuse-mounting section 29 on the upper side of the fuse unit 40. With the above components in this assembled state, the engaging protuberances 27A, 27B formed on opposite sides of the fuse mounting portion 29 are elastically engaged with the upper end of the casing 1 while at the same time the connecting terminals 13*a*, 13*b* and the coupling terminal 28 are inserted into the terminal holding frame 30.

The yoke 2 and the covering member 8 thus assembled together is placed into the casing 1. Then, the power supply-connecting terminal 20 of the battery is superposed onto the coupling terminal 28 mounted in the casing 1, followed by fitting the bolt 27 through the through hole 20*a* of the power supply-connecting terminal 10, the through hole 28*a* of the coupling terminal 28, and the through hole 10*g* of the fixed contact member 10, to fasten them together with the nut 17 screwed onto the bolt 27. In the meanwhile, the connecting terminal 22 of the starting motor, is superposed onto the fixed contact member 11, followed by fitting the bolt 23 through the through hole 22*a* of the connecting terminal 22 and the through hole 11*a* of the fixed contact member 11, to fasten them together with the nut 18 screwed onto the bolt 23.

FIG. 11 illustrates an example of a circuit formed by component parts of the electromagnetic switch provided with the fuse unit and load circuits for an automotive vehicle. When a main switch 33 (e.g. a key switch of the vehicle) is closed, electric power is supplied from the battery 35 to a load 34 or electric device of the vehicle as a second load circuit through the blade fuse 24 and the bifurcated connecting portion 26*b*. Then, when a starting switch 37 of the vehicle is closed, the coil 4 is energized to move the plunger 6 downward as viewed in FIG. 3 against the biasing force of the return spring 5. The movable contact member 7 is accordingly moved downward by the biasing force of the spring 9 whereby connection between the movable contact member 7 and the two fixed contact members 10 and 11 is established, which permits electric power to be supplied from the battery 35 to the staring motor 25. In the meanwhile, the bifurcated portion 26*a* is connected with an AC generator 39 as another second load circuit through a rectifier 38 to charge the battery 35 with output current from the AC generator 39.

After the electromagnetic switch 30 is repeatedly opened and closed over a long time, chips or particles produced at the contacts 14 are accumulated in the annular recess 6*a* formed in the upper end face of the plunger 6. Further, since the casing 1 is formed of an insulating material, when the coil 4 is energized to pull the plunger 6 into the bobbin 3 to bring the movable contact member 7 into contact with the fixed contact members 10, 11, no leakage current caused by the presence of chips or particles is allowed to flow from the contacts 14 to the mounting structure (vehicle body) through the plunger 6 and the yokes 2, 12.

Figure 7:
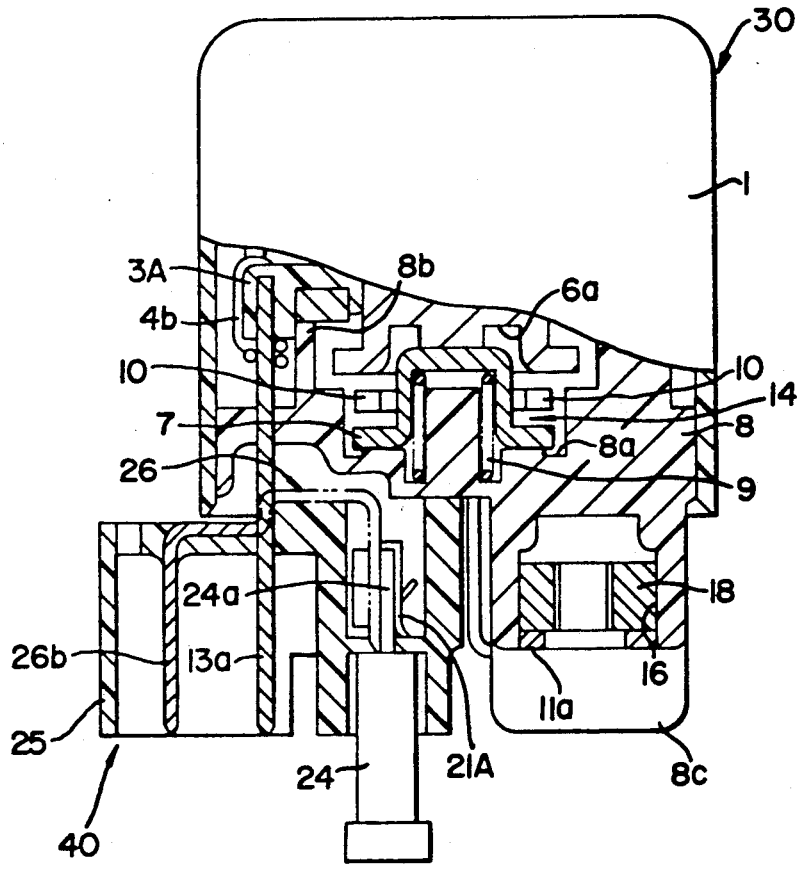
FIG. 7 is a side view, partly in section, of the electromagnetic switch of FIG. 3, which is in an inverted position.

Furthermore, since the chips or particles are blocked by the partition wall 8*b*, they are not scattered as far as the leader ends 4*a*, 4*b* of the coil 4. Further, as shown in FIG. 7, when the electromagnetic switch is invertedly mounted in use, the chips or particles produced at the contacts 14 are accumulated in the annular recess 8*a* of the covering member 8, and in this case as well, the chips or particles scattering toward the ends 4*a*, 4*b* of the coil 4 are blocked by the partition wall 8*b*.

Since the movable contact member 7 is always kept in contact with the plunger 6 by the spring 9, heat produced at the contacts 14 is sufficiently dissipated through the plunger 6.

The fixed contact members 10, 11 may be formed by bending a metal sheet into a generally U-shaped section. Therefore, it is quite easy to manufacture the fixed contact members 10, 11. Further, while conventional fixed contact members having a connecting threaded portion and a plate-shaped contact portion formed of copper formed integrally therewith, have the disadvantage that the threaded or bolt portion can be broken when terminals of connecting wires are fastened to the fixed contact members with nuts. However, according to the above described embodiment of the invention, since the connecting terminals 20, 22 are fastened to the flat upper surfaces of the horizontal portions 10*a*, 11*a* of the U-shaped fixed contact members 10, 11 by the bolts 32, 27 and nuts 17, 18, the above disadvantage can be overcome.

Further, since the U-shaped fixed contact members 10, 11 are assembled to the covering member 8 from outside thereof, it is easy to effect the assemblage. Further, if engaging ribs 10*f*, 11*f* are provided on the respective lower end faces of the lower horizontal portions 10*b*, 11*b*, of the U-shaped fixed contact members 10, 11, when the upper horizontal portions 10*a*, 11*a* of the fixed contact members 10, 11 are inserted into the holes 8B of the covering member 8, the engaging ribs 10*f*, 11*f* are pressed against the bottom surfaces of the holes 8B, whereby the fixed contact members 10, 11 can be stably held in place within the covering member 8 without being shaken.

The provisional assembly in which the square bobbin 3 is held between the covering member 8 and the yoke 2, and the lugs 2A, 2B of the yoke 2 have been caulked to firmly join the yoke 2 and the covering member 8 together is placed into the casing 1 made of resin. Thus, a rigid assembly is obtained with high vibration resistance, wherein the rotation of the bobbin 3 relative to the casing 1 is prevented.

Since the fuse unit 40 is coupled to the casing with the engaging protuberances 27A, 27B of the fuse unit 40 elastically engaged with the fitting recesses 1A, 1B of the casing 1, it is easy to firmly assemble the fuse unit into the electromagnetic switch. Thereafter, a waterproofing agent may be poured into a space defined between the fuse unit 40 and the upper end of the casing 1. Thus, waterproofing of the electromagnetic switch can be easily carried out after assembly.

Since the output terminal 26 and the coupling terminal 28 are force fitted into the fuse unit, and the terminals are enclosed by the bottom of the fuse unit 40 and the covering member 8 of the electromagnetic switch 30, waterproofing can further be enhanced.

Figure 12:
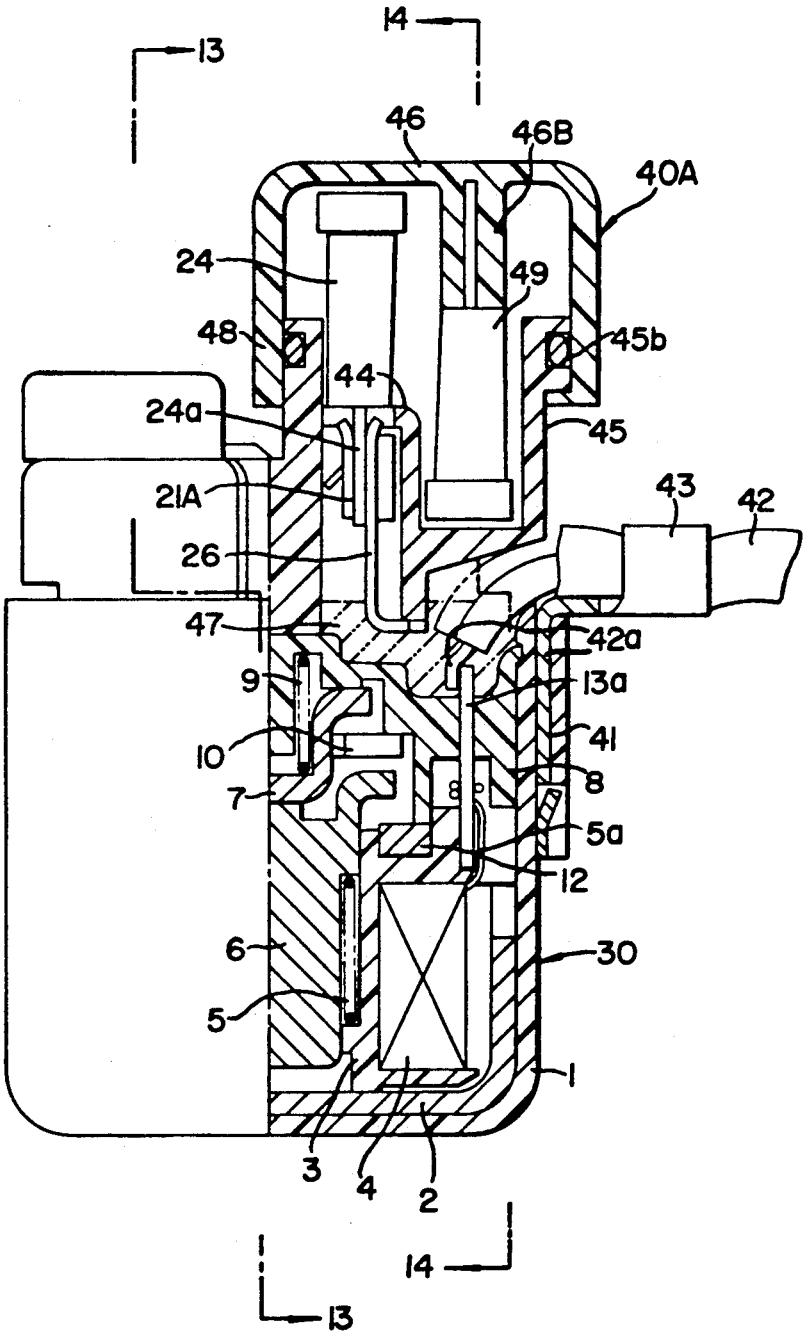
FIG. 12, is a side view, partly in section, of an electromagnetic switch according to a second embodiment of the invention.
Figure 14:
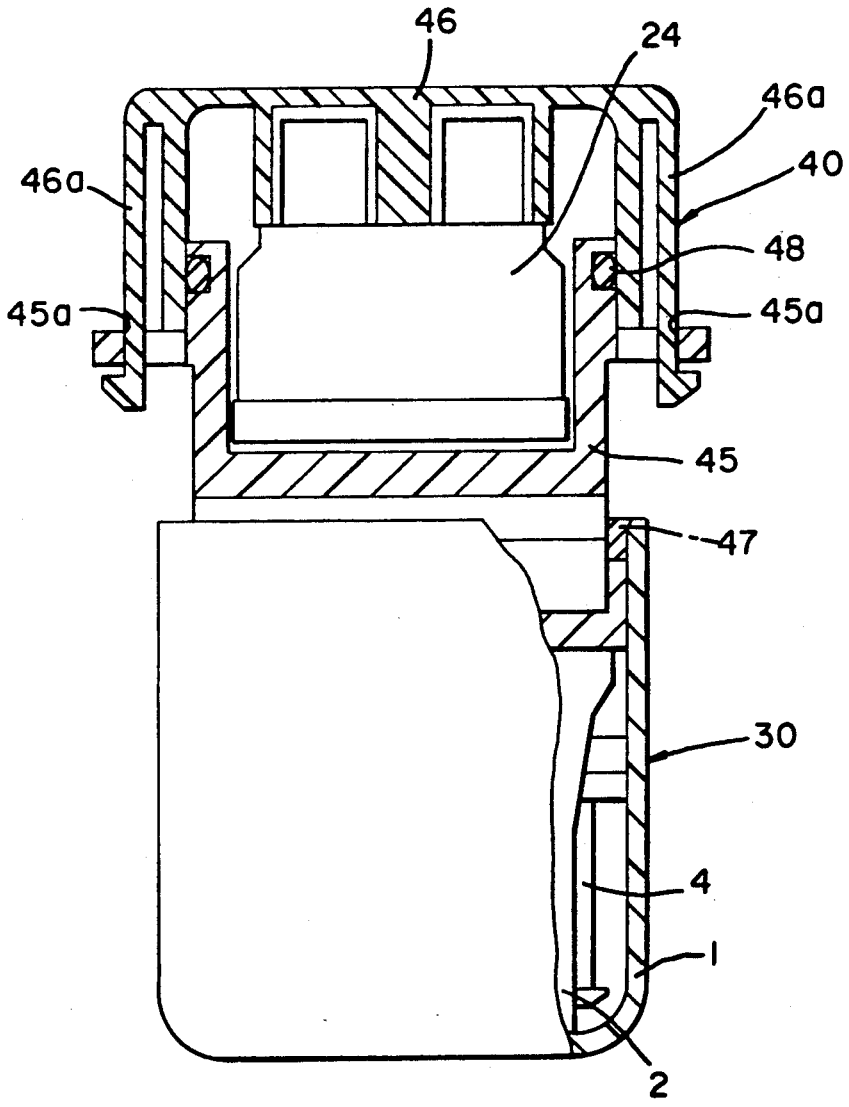
FIG. 14 is a side view, partly in section, taken along line XIV—XIV in FIG. 13.

FIGS. 12 and 14 show an electromagnetic switch according to a second embodiment of the invention. In the second embodiment, like reference numerals are used to designate component parts corresponding to those of the first embodiment, and description thereof is therefore omitted.

The leader ends of a coil 4 (only one 4*a* of which is shown) are connected to connecting terminals (only one 13*a* of which is shown) which upwardly project from a covering member 8 with their tips located below the level of the upper end of a casing 1. The tips of the connecting terminals 13*a* are soldered to wires 42*a* of a connecting cord 42. The connecting cord 42 is clamped by a cord clamper 43, part of which is firmly held between a lateral side wall of the casing 1 and a holding portion 41 formed integrally with the casing 1.

Mounted on an upper end portion of the electromagnetic switch 30 is a fuse unit 40A, which comprises a fuse holding frame 45 having a square configuration in which a fuse mounting section 44 is formed on which is dismountably mounted a blade fuse 24, and a cap 46 removably fitted over the fuse holding frame 45. One blade 24*a* of the blade fuse 24 is connected to a coupling terminal, not shown, via a connector 21A, while the other blade, not shown, of the blade fuse 24 is connected to an output terminal 26 via another connector, not shown. The output terminal 26 is connected to one or more load circuits, such as electric devices of an automotive vehicle.

Figure 13:
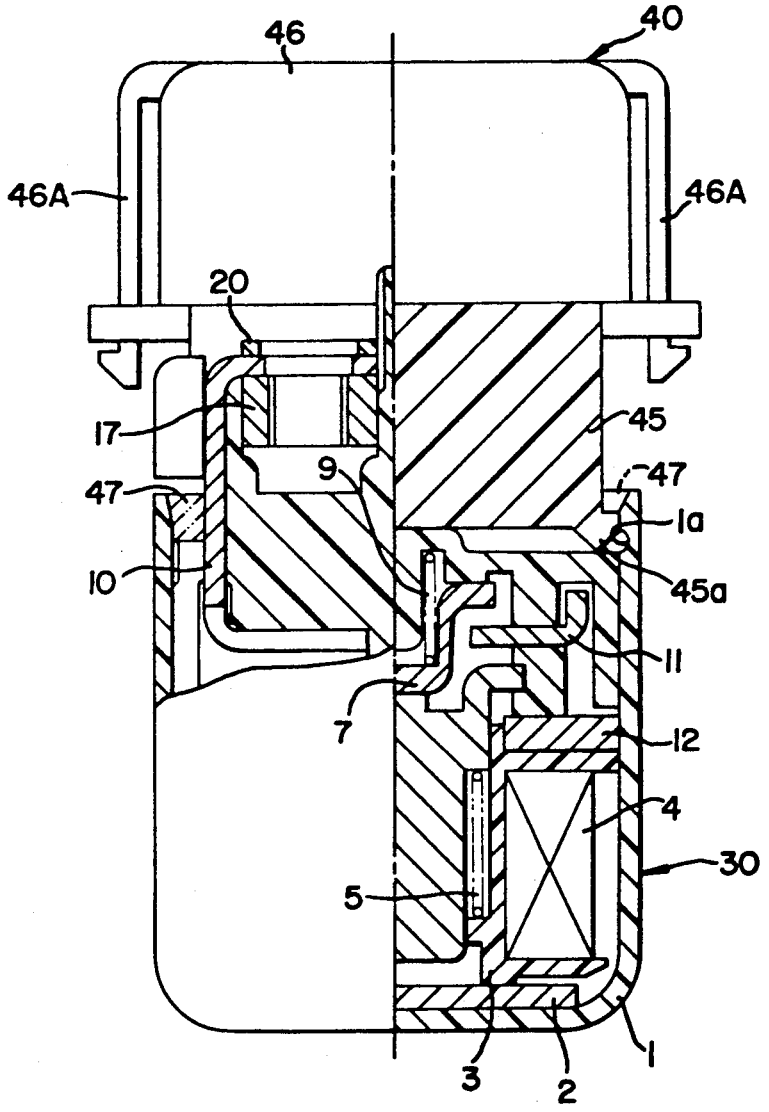
FIG. 13, is a side view, partly in section, taken along line XIII—XIII in FIG. 12.

As shown in FIG. 13, the fuse mounting frame 45 is fitted in an upper end of the casing 1, and engaging protuberances 45*a* are formed at a lower edge of the fuse holding frame 45. The engaging protuberances 45*a* are engaged in engaging recesses 1*a* formed in the casing 1 at portions slightly downward of the upper end edge thereof. A waterproof agent 47 such as epoxy resin is filled into a space defined between an outer periphery of the fuse holding frame 45 and the upper end of the casing 1.

Formed in an upper outer surface of the fuse holding frame 45 is an annular groove 45*b* in which a square O-ring 48 is fitted as a sealing member in contact with an inner surface of the cap 46. The cap 46 has an inner ceiling surface thereof formed integrally with a boss 46B on which a spare fuse 49 for the blade fuse 24 is mounted. Integrally formed at opposite sides of the cover 46 are legs 46A and 46A extending downwardly from an upper end of the cover 46 and having respective engaging claws at lower free ends thereof, as best shown in FIG. 14. The engaging claws of the legs 46A and 46A extend through engaging holes 45A and 45A formed in flanges integral with the fuse holding frame 45 at opposite sides thereof.

Since the waterproof agent 47 is filled in the space between the fuse holding frame 45 of the fuse unit 40 and the upper end of the casing 1 of the electromagnetic switch 30, the open upper end of the casing 1 or the lower end portion of the fuse unit 40, which is liable to intrusion of water from the outside, is completely sealed. Further, since the cap 46 covers the upper end portion of the fuse unit 40 via the O-ring 48, the fuse unit 40 is also completely sealed against water intrusion through the upper end thereof.

What is claimed is:

1. In an electromagnetic switch including a yoke;

a bobbin received in said yoke;

a coil wound around said bobbin;

a plunger accommodated within said bobbin, said plunger being movable axially of said bobbin in response to energization of said coil;

a movable contact member being movable with movement of said plunger;

at least one fixed contact member with which said movable contact member is brought into and out of contact; and a casing in which are received said yoke, bobbin, coil, plunger, movable contact member and fixed contact member, the improvement comprising:

said casing having a square box-shaped body with a closed end and another open end, and a covering member fitted in the other open end of the square box-shaped body; and said yoke having a sheet member with a generally U-shaped section and opposite end portions between which a portion of the covering member is interposed, the opposite end portions being formed in part into at least one pair of inwardly extending lugs, the lugs being force-fitted in the portion of the covering member.

2. In an electromagnetic switch as claimed in claim 1, wherein the portion of the covering member has at least one pair of grooves formed at opposite sides thereof, the lugs being fitted in the grooves and caulked.

3. In an electromagnetic switch as claimed in claim 1 or claim 2, wherein said bobbin has a square peripheral portion fitted in said yoke.

4. In an electromagnetic switch as claimed in claim 3, wherein the square peripheral portion of said bobbin includes a pair of rectangular flanges formed at opposite ends of said bobbin.

5. In an electromagnetic switch including a bobbin;

a coil wound around said bobbin and having leader ends;

a plunger accommodated within said bobbin, said plunger being movable axially relative to said bobbin in response to energization of said coil;

contact means having a movable contact member, and at least one fixed contact member, the movable contact member being brought into and out of contact with the fixed contact member in accordance with movement of said plunger; and a casing in which are received said coil, bobbin, plunger, and contact means, the improvement comprising:

said casing having a body, and a covering member covering said body, said covering member having an annular recess formed in a side surface thereof opposed to said contact means for receiving particles from said contact means, the annular recess being located outside an operating portion of the covering member which protrudes toward the movable contact member between the movable contact member and said plunger.

6. In an electromagnetic switch as claimed in claim 5, wherein said plunger has an end face opposed said contact means, the end face having a recess formed therein.

7. In an electromagnetic switch as claimed in claim 10 or claim 6, wherein said bobbin has an end opposed to the covering member, said electromagnetic switch further including a second yoke disposed on the end face of said bobbin, and the covering member having a partition wall extending from the covering member to said second yoke.

8. In a electromagnetic switch including a coil;

a plunger being movable in response to energization of said coil;

a movable contact member being movable with movement of said plunger;

at least one fixed contact member with which movable contact member is brought into and out of contact, one of said at least one fixed contact member being connectible to a power supply;

a casing in which are received said plunger, movable contact member and fixed contact member; and a fuse unit joined with said casing and having a fuse connected between said one fixed contact member and at least one load circuit, the improvement comprising:

said fuse unit having a fuse holding frame accommodating the fuse and fitted to said casing, a removable cap covering the fuse holding frame, a sealing member interposed between the fuse holding frame and the cap, and a water-proofing agent filled in a space defined between said fuse unit and said casing.

9. In an electromagnetic switch as claimed in claim 8, wherein the cap has a space defined therein mounting a spare blade fuse.

10. In an electromagnetic switch as claimed in claim 5, wherein the covering member has a partition wall formed thereon and separating said contact means from the leader ends of said coil.

11. In an electromagnetic switch as claimed in claim 5, wherein said plunger includes a recess formed in a face of said plunger, near said contact means.

12. In an electromagnetic switch as claimed in claim 11, wherein the recess of said plunger is an annular recess.

* * * * *